US009453646B2

(12) United States Patent
Singh

(10) Patent No.: US 9,453,646 B2
(45) Date of Patent: Sep. 27, 2016

(54) METHOD FOR AIR ENTRY IN LINER TO REDUCE WATER REQUIREMENT TO CONTROL NOX

(71) Applicant: General Electric Company, Schenectady, NY (US)

(72) Inventor: Arjun Singh, Bangalore (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/608,342

(22) Filed: Jan. 29, 2015

(65) Prior Publication Data

US 2016/0223200 A1 Aug. 4, 2016

(51) Int. Cl.
*F02C 1/00* (2006.01)
*F23R 3/06* (2006.01)
*F23R 3/04* (2006.01)

(52) U.S. Cl.
CPC *F23R 3/06* (2013.01); *F23R 3/045* (2013.01)

(58) Field of Classification Search
None
See application file for complete search history.

(56) References Cited

U.S. PATENT DOCUMENTS 2,930,193 A * 3/1960 Jaramillo ..... 60/756
5,261,223 A * 11/1993 Foltz ..... 60/804
5,687,572 A * 11/1997 Schrantz ..... F23R 3/007 431/352
5,819,540 A 10/1998 Massarani
5,996,351 A 12/1999 Feitelberg et al.
6,192,689 B1 2/2001 Feitelberg et al.
6,286,298 B1 9/2001 Burrus et al.
8,171,740 B2 5/2012 Bronson et al.
8,616,004 B2 12/2013 Zupanc et al.
2002/0017101 A1* 2/2002 Schilling et al. ..... 60/747
2003/0177769 A1* 9/2003 Graves et al. ..... 60/752
2007/0227150 A1* 10/2007 Alkabie et al. ..... 60/754
2009/0013530 A1* 1/2009 Rudrapatna et al. ..... 29/888
2015/0377134 A1* 12/2015 Maurer ..... F02C 7/18 60/754

* cited by examiner

*Primary Examiner* — Gerald L Sung
(74) *Attorney, Agent, or Firm* — Nixon & Vanderhye P.C.

(57) ABSTRACT

An improved combustor is disclosed in which conventional combustion is changed to "rich to quench to lean" by changing the air entry arrangement in the liner of the combustor to remove mixing holes, reduce liner cooling and admit dilution air into the combustor liner in place of mixing air. In an alternative embodiment, dilution air is admitted into the combustor liner with the help of a plurality of pipes arranged so that air comes into the liner as a swirling flow in a direction opposite to nozzle swirl, so as to thereby produce a large mixing of air with the combustion gases and a resulting quenching effect, i.e., a rapid cooling of the combustion gases by quenching air. As such, the requirement for cooling water to quench the combustion gases is significantly reduced, thereby helping turbine efficiency and reducing turbine emissions.

15 Claims, 11 Drawing Sheets

METHOD FOR AIR ENTRY IN LINER TO REDUCE WATER REQUIREMENT TO CONTROL NOX

The present invention relates turbines, and more particularly to a method of introducing air into a gas turbine combustor to reduce combustor NOx emissions and water requirements in reducing such emissions.

BACKGROUND OF THE INVENTION

Gas turbine engines include a compressor for compressing air that is mixed with fuel and ignited in a combustor for generating combustion gases. The combustion gases from the combustor flow to a turbine that extracts energy for driving a shaft to power the compressor and produces output power, often for powering an electrical generator.

Increased requirements for low emissions from turbine power plants now require low rates of emissions of NOx (mono-nitrogen oxides NO (nitric oxide) and $NO_2$ (nitrogen dioxide)), CO (carbon monoxide) and other pollutants from turbine combustors.

Conventional turbine combustors use non-premixed diffusion flames, where fuel and air freely enter the combustion chamber separately and mixing of the fuel and air occurs simultaneously with combustion, and where resulting flame temperatures typically exceed 4000° F. with NG, LF or syngas fuels, so as to produce relatively high levels of NOx emissions. Thus, temperatures in combustion chamber primary zones can get very high if water is not injected, although temperatures do drop along the length of the combustion chamber. Water is generally used because a diffusion flame is used in these combustors and primary zone temperatures are very high and produce NOx as much as approximately 250 ppm with syngas/LF fuels and approximately 120 ppm with NG fuel if water is not used.

Approximately 95% of the combustor exiting NOx, which is measured in ppmvd (parts per million, volumetric dry) @15% O2, has already been formed before the combustion gases reach the dilution holes in a conventional combustor liner. NOx formation rates are highest in a narrow zone of the combustion chamber, and become very much less so after the combustion gases reach the dilution holes in the conventional combustor liner. Thus, air introduced by dilution holes in a conventional combustor liner does not participate in a reduction of combustion gases' temperatures and NOx production.

As is explained in the background section of U.S. Pat. No. 6,192,689, one method commonly used to reduce peak temperatures in conventional diffusion flame combustors, and thereby reduce NOx emissions, is to inject water or steam into the combustor. However, water or steam injection is a relatively expensive technique and can cause the undesirable side effect of quenching (i.e., rapid cooling) carbon monoxide (CO) burnout reactions, and which is limited in its ability to achieve low levels of pollutants.

Conventional diffusion flame combustors are effective for burning natural gas (NG), synthesis gas (syngas) and liquid fuels (LF) in low megawatt (MW) turbine machines. But conventional combustors use a very old liner cooling design that involves the use of water or steam injection, which is not desirable in gas turbine power plants from life of components, operability and cost of electricity perspectives. Sufficient efforts have not been made to reduce water consumption in these machines.

BRIEF DESCRIPTION OF THE INVENTION

The present invention seeks to reduce water requirements in conventional combustors to reduce temperatures and NOx emissions when operating on NG/LF or syngas fuels. In the present invention, combustion in a conventional combustor is changed from "rich to lean" to "rich to quench to lean" by changing the air entry arrangement in the liner of the conventional combustor. In this changed air entry arrangement, dilution holes are removed, liner cooling is reduced and dilution air is admitted into the combustor liner in place of mixing air admitted into the combustor liner through a third row of mixing holes. In an alternative embodiment, dilution air is admitted into the combustor liner with the help of a plurality of pipes arranged in such a manner so that such air comes into the liner as a swirling flow in a direction opposite to nozzle swirl, so as to thereby produce a large mixing of air with the combustion gases and a resulting quenching effect, i.e., a rapid cooling of the combustion gases by quenching air. As such, the requirement for cooling water to quench the combustion gases is significantly reduced, thereby helping in turbine efficiency and a reduction in turbine emissions.

The present invention reduces temperatures in the primary reaction zone of a combustor by moving dilution air upstream and providing swirl to incoming air to enhance mixing. Reduction in temperature leads to reduction in NOx generation which is very high in conventional liners before combustion gases reach the dilution holes in the combustor. The present invention also reduces the cooling water requirement in conventional liners, which is typically very high.

In a first embodiment of the present invention, a combustor operating with a compressor to drive a gas turbine is comprised of an outer combustor wall having an upstream fuel entry end and a downstream turbine entry end; a plurality of mixing holes located proximal to the upstream fuel entry end of the outer combustor wall; and a plurality of dilution holes located proximal to the plurality of mixing holes to admit air into a combustion zone in the combustor for mixing of the admitted air with combustion gases in the combustion zone to thereby reduce NOx and carbon monoxide (CO) production in the combustion zone.

In another embodiment of the present invention, a combustor operating with a compressor to drive a gas turbine is comprised of an outer combustor wall having an upstream fuel entry end and a downstream turbine entry end; a plurality of mixing holes located proximal to the upstream fuel entry end of the outer combustor wall, the plurality of mixing holes being arranged in a plurality of rows which extend around a circumference of the outer combustor wall; and a plurality of dilution holes arranged in one or more rows which extend around the circumference of the outer combustor wall, the plurality of dilution holes being located proximal to the plurality of mixing holes; an outer shell; a nozzle from which compressed air and fuel are discharged into combustor; a flow sleeve located between the outer shell and the combustor wall so as to form a cavity between the outer shell and the combustor wall so that air from the compressor entering the combustor is divided between a first path by which a first part of the compressor air is admitted into the combustor by entering through the flow sleeve, and a second path by which a second part of the compressor air is admitted into the combustor through the cavity; and a plurality of pipes extending between the cavity and the plurality of dilution holes to admit the second part of the compressor air into the combustion zone for increased mixing of the admitted air with combustion gases in the combustion zone to thereby reduce NOx and carbon monoxide (CO) production in the combustion zone.

In a further embodiment of the present invention, a combustor operating with a compressor to drive a gas turbine is comprised of an outer combustor wall having an upstream fuel entry end and a downstream turbine entry end, the outer combustor wall having a length between 35 inches and 50 inches; a plurality of rows of liner louver cooling holes positioned longitudinally along the combustor wall; a plurality of mixing holes located proximal to the upstream fuel entry end of the outer combustor wall; the plurality of dilution holes being located proximal to the plurality of mixing holes; the plurality of mixing holes being arranged in first and second rows which extend around a circumference of the outer combustor wall rather than first, second and third rows which extend around the circumference of the outer combustor wall so that the plurality of dilution holes are arranged in the third row from the upstream fuel entry end extending around the circumference of the outer combustor wall so as to be located within a distance of five inches to forty inches from the fuel entry end of the combustor wall; an outer shell; a nozzle from which compressed air and fuel are discharged into combustor; a flow sleeve located between the outer shell and the combustor wall so as to form a cavity between the outer shell and the combustor wall so that air from the compressor entering the combustor is divided between a first path by which a first part of the compressor air is admitted into the combustor by entering through the flow sleeve, and a second path by which a second part of the compressor air is admitted into the combustor through the cavity; and a plurality of pipes extending between the cavity and the plurality of dilution holes at an angle to thereby tangentially admit the second part of the compressor air into the combustion zone for increased mixing of the admitted air with combustion gases in the combustion zone, the angle at which the pipes enter the combustor being achieved using an offset of the pipes of zero to seven inches from the center of the combustor, the diameters of the plurality of dilution holes though which air from the plurality of pipes is passed into the combustor being increased to a dimension that results in an increase in air flow into the combustor combustion chamber, and the diameters of the plurality of louver cooling holes though which louver cooling air passes being reduced to a dimension that results in a further increase in mixing of the admitted air with combustion gases in the combustion zone to thereby reduce NOx and carbon monoxide (CO) production in the combustion zone.

DETAILED DESCRIPTION OF THE INVENTION

Figure 1:
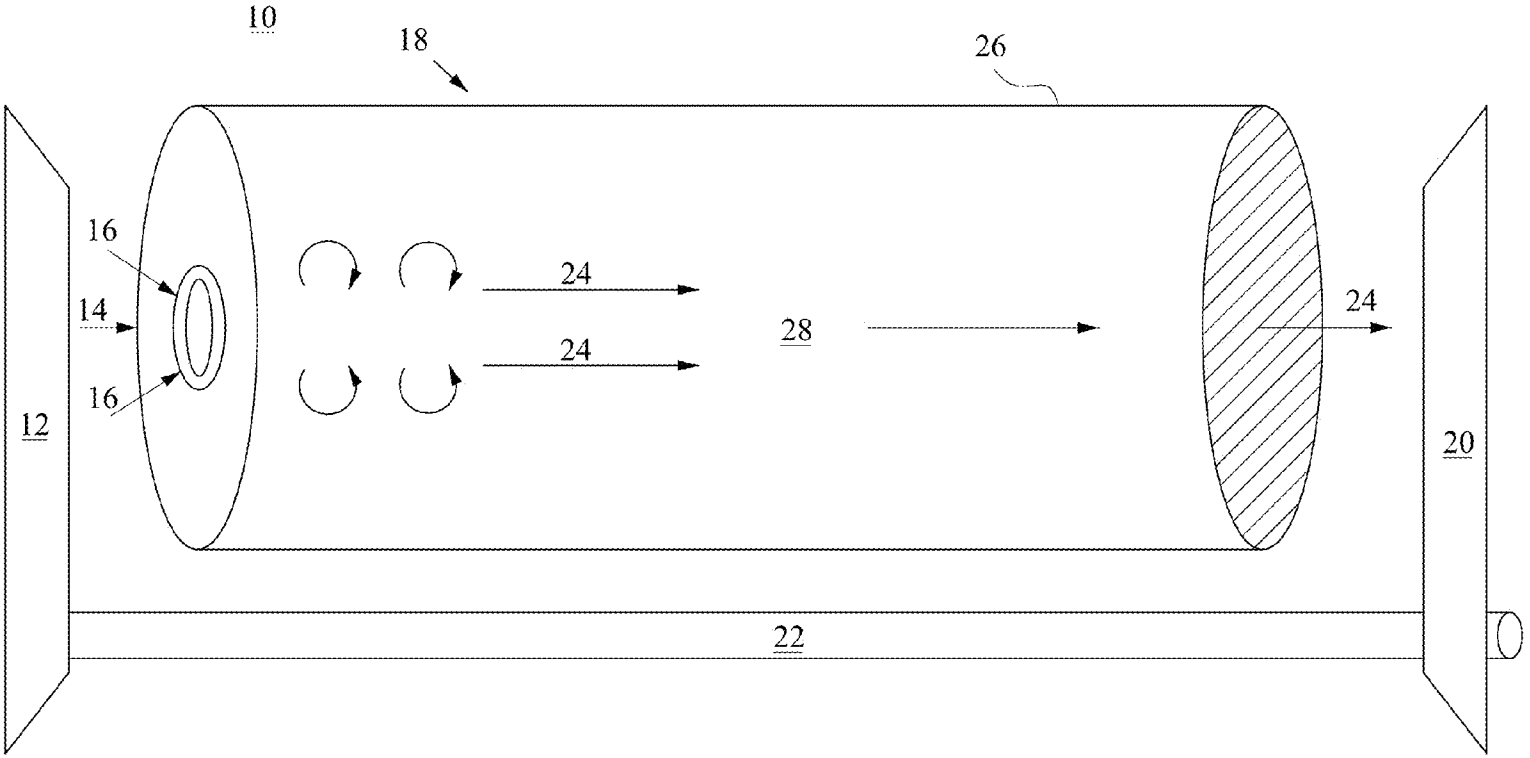
FIG. 1 (Prior Art)
FIG. 1, which is a figure from U.S. Pat. No. 6,192,689, is a schematic representation of a portion of an industrial gas turbine engine having a low NOx combustor joined in flow communication with a compressor and turbine.

FIG. 1 of U.S. Pat. No. 6,192,689 is a schematic representation of a portion of an exemplary industrial gas turbine engine 10 having a low NOx combustor 18 joined in flow communication with a compressor 12 and turbine 20. The industrial gas turbine engine 10 includes a compressor 12 for compressing air 14 that is mixed with fuel 16 and ignited in at least one combustor 18, as shown in FIG. 1. A turbine 20 is coupled to compressor 12 by a drive shaft 22, a portion of which drive shaft 22 extends for powering, for example, an electrical generator (not shown) for generating electrical power. During operation, compressor 12 discharges compressed air 14 that is mixed with fuel 16 and ignited for generating combustion gases 24 from which energy is extracted by turbine 20 for rotating shaft 22 to power compressor 12, as well as for producing output power for driving the generator or other external load. Combustor 18 comprises a cylindrical combustor wall 26, which defines a combustion chamber 28 cylindrical combustor wall 26.

Figure 2A:
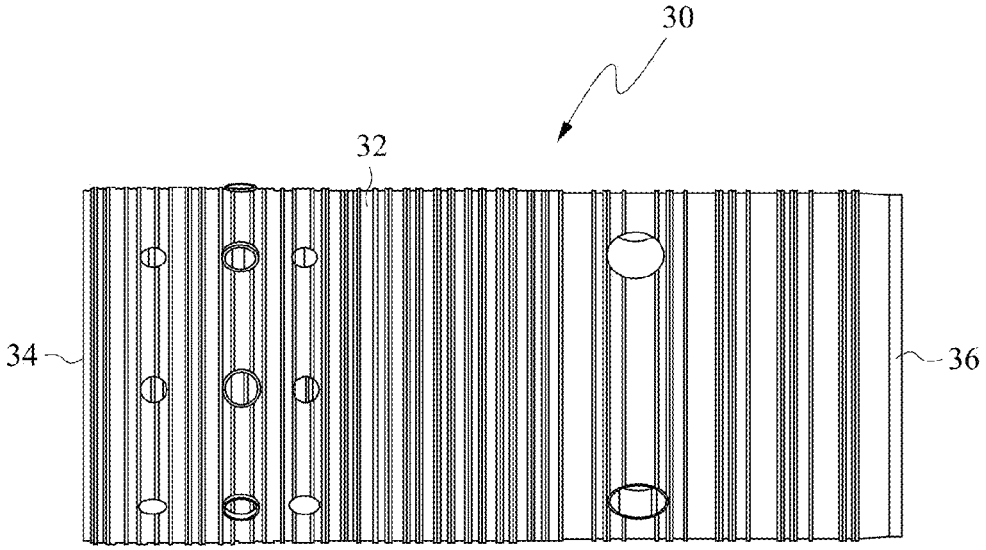
FIGS. 2A and 2B are side elevational and perspective schematic representations, respectively, of a conventional combustor liner used in an industrial gas turbine engine.
Figure 2B:
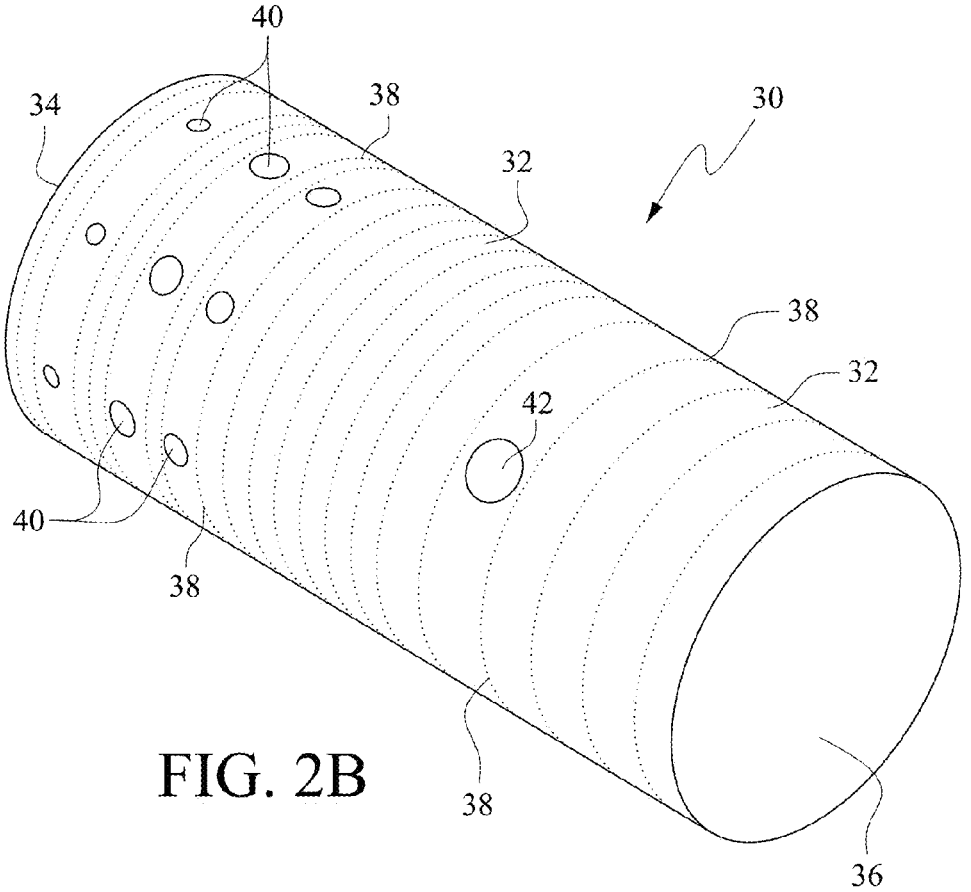

FIGS. 2A and 2B are side elevational and perspective schematic representations, respectively, of a conventional combustor liner 30 used in an industrial gas turbine engine 10. The combustor 30 includes a cylindrical combustor wall 32 having a fuel entry end 34 and a turbine entry end 36. The combustor liner 30 includes a plurality of rows of liner louvers cooling holes 38 positioned longitudinally along the liner 30 and having different diameters at different positions along the liner 30.

The combustor liner 30 is also comprised of several sets of air holes disposed about its periphery. A first set of air holes 40, referred to as mixing holes, supply a quantity of air to the reaction zone within combustion chamber 28. The mixing holes 40 are disposed proximate to the fuel entry end 34 of combustor 30 to provide an entry for mixing air. The number of mixing holes 40 is variable, typically depending on the overall size of combustor 30. A second set of air holes 42 are positioned at the downstream end of the combustion chamber to quench combustion gases 24 prior to entering a transition piece (not shown) or a turbine inlet (not shown).

A second set of air holes 42, called dilution holes, are disposed in a central region of the combustor 30, closer to the downstream end of the combustion chamber 28 within combustor 30. The dilution holes 42 provide an entry area for dilution air into to combustor 30. The dilution air is provided to lower the temperature of combustion gases 24 prior to entering a turbine inlet (not shown) or a transition piece (not shown).

The temperature field within combustor 30 during operation is such that temperatures are very high in the primary zone of combustor 30, if water is not injected into combustor 30, although it should be noted that temperatures drop along the length of combustor 30.

The formation of NOx within combustor 30 during operation is such that approximately 95% of the ppmvd@15% NOx has already been formed before the combustion gases 24 reach the dilution holes 42. NOx formation rates are highest in a narrow zone, with not much of the NOx being formed after the dilution holes 42 in combustor 30. Thus, the dilution holes' air does not participate in temperature and NOx reduction in conventional combustor 30.

In the present invention, combustion in a conventional combustor is changed from "rich" to "lean" to "rich" to "quench" to "lean" by changing the air entry arrangement of the conventional combustor. In the air entry arrangement according to the present invention, dilution holes are removed from the region of the combustor closer to the downstream end of the combustion chamber within combustor, liner cooling is reduced and air is admitted into the combustor at the third row of the mixing holes with the help of a plurality pipes arranged in a manner that causes air coming from the pipes to enter the combustor 30 as swirling flow in a direction opposite to nozzle swirl, so as to therefore produce a large mixing and quenching effect. In a preferred embodiment of the modified combustor according to the present invention, the plurality of pipes comprises six pipes.

Figure 3:
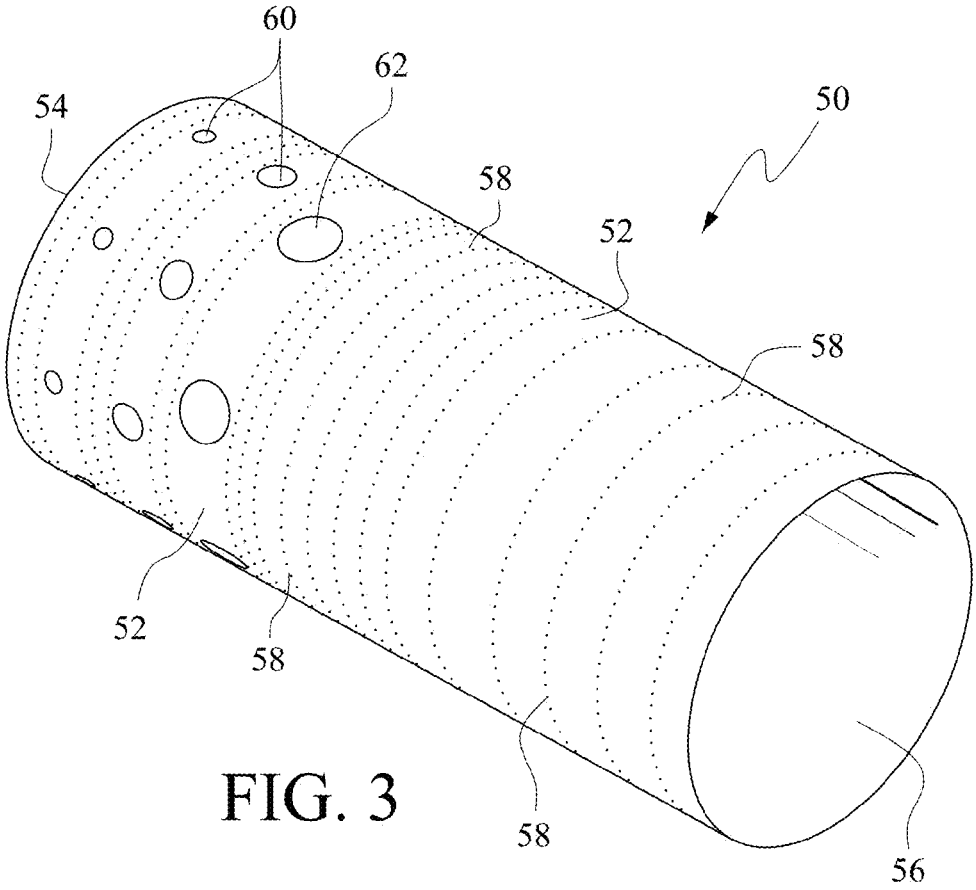
FIG. 3 is a perspective schematic representation of a combustor liner according to the present invention.

FIG. 3 is a perspective schematic representation of a combustor liner 50 according to the present invention. The combustor 50 includes a cylindrical combustor wall 52 having a fuel entry end 54 and a turbine entry end 56. In the combustor 50, the air entry arrangement has been changed so that dilution air is admitted into the combustor 50 closer to a fuel entry end 54. The combustor wall 52 also has a plurality of rows of liner louver cooling holes 58 positioned longitudinally along the combustor 50 and having different diameters at different positions along the combustor 50.

Like the combustor shown in FIGS. 2A and 2B, the combustor 50 includes several sets of air holes disposed about its periphery. Here again, the combustor 50 includes a set of mixing holes 60 which are disposed proximate to the fuel entry end 54 of combustor 50 to provide an entry for a quantity of mixing air to be supplied to the reaction zone within the combustion chamber 28. The combustor 50 also includes a set of dilution holes 62. Again, the number of mixing holes 60 and the number of dilution holes 62 vary according to the overall size of combustor 50.

Like the combustor disclosed in U.S. Pat. No. 6,192,689, a preferred embodiment of the combustor wall 52 has a preferred nominal diameter (d) in the range between about 9 inches to about 15 inches and a preferred nominal length (L) in the range between about 35 inches to about 50 inches. In addition, the mixing holes 60 have a preferred diameter in the range between about 0.5 inches to about 1 inch, and the dilution holes 62 have a preferred diameter in the range between about 1.25 inches to about 4.0 inches.

Figure 4A:
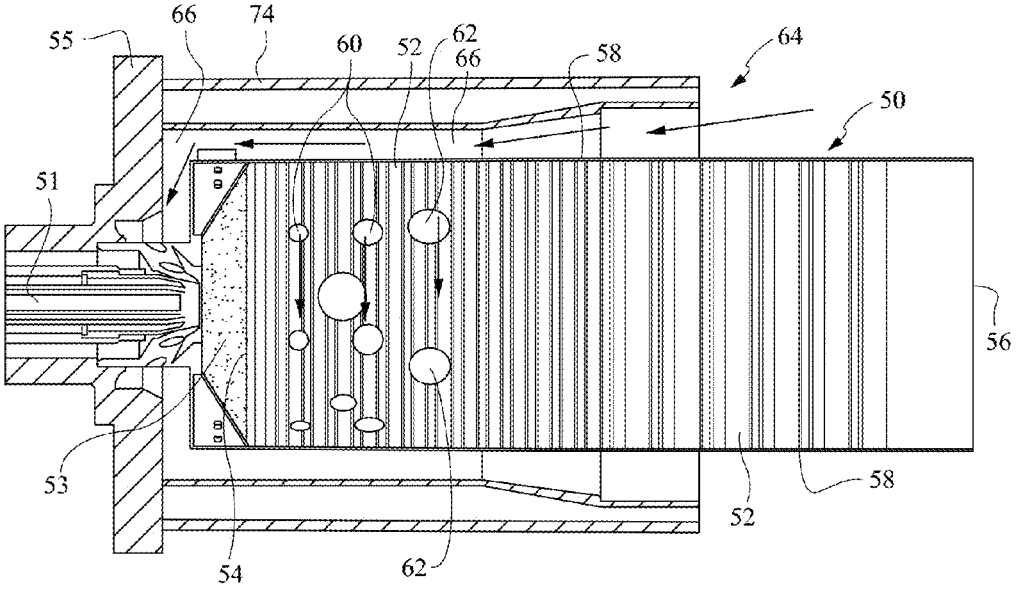
FIGS. 4A to 4C show a first embodiment of a Dry Low NOx ("DLN") combustion system incorporating the combustor liner shown in FIG. 5.
Figure 4B:
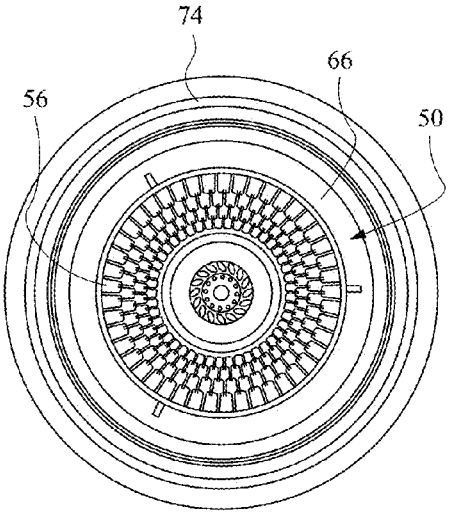
Figure 4C:
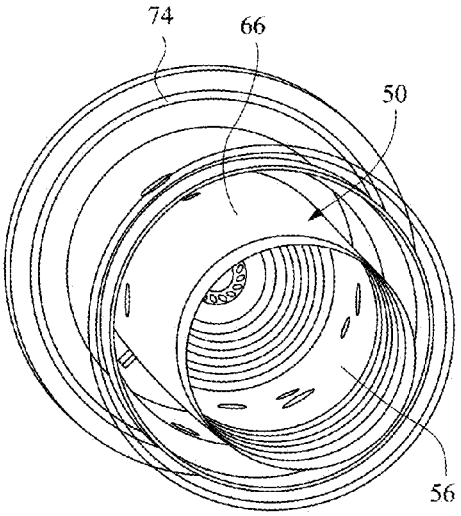

FIGS. 4A to 4C show a first embodiment of a Dry Low NOx ("DLN") combustion system incorporating the combustor liner 50 shown in FIG. 3. The DLN combustion system includes combustor liner 50, a nozzle 51 from which compressed air 14 and fuel 16 that is mixed with the compressed air 14 is discharged into combustor 50 and a diverging cone 53 positioned between nozzle 51 and combustor 50. An endplate 55 holds the body of the combustor 50 together.

In the preferred embodiment shown in FIGS. 4A to 4C, the mixing holes 60 are preferably arranged in two rows, which extend around the circumference of the cylindrical combustor wall 52, and which are proximate to the fuel entry end 54 of the cylindrical combustor wall 52. The dilution holes 52 are arranged in a single row, which replaces a third row of mixing holes that would typically be present in a conventional combustor. The row of dilution holes 52 preferably extends around the circumference of the cylindrical combustor wall 52, and is proximate to the two rows of mixing holes 60 in cylindrical combustor wall 52 so that dilution air is admitted into the combustor 50 proximate to the fuel entry end 54 of combustor 50. In a preferred embodiment of the claimed combustor 50, the dilution holes 62 are located within a range of 5 inches to 40 inches from the fuel entry end 54 of the combustor wall 52. Thus, in the preferred embodiment shown in FIGS. 4A to 4C, part of the mixing holes 60, i.e., those typically located in the third row of mixing holes are removed, and the number of dilution holes 62 is increased. Preferably, eight of the 24 mixing holes 60 in a conventional combustor, i.e., those holes in the third row of mixing holes, are removed, and the number of dilution holes 62 is increased from four typically in a conventional combustor to six to maintain jet penetration for mixing air to be supplied to the reaction zone within the combustion chamber 28. Mid-frame air 64 from the compressor 12 continues to be admitted into the combustor 50 by entering through flow sleeve 66 within a shell 74 containing combustor 50.

Figure 5A:
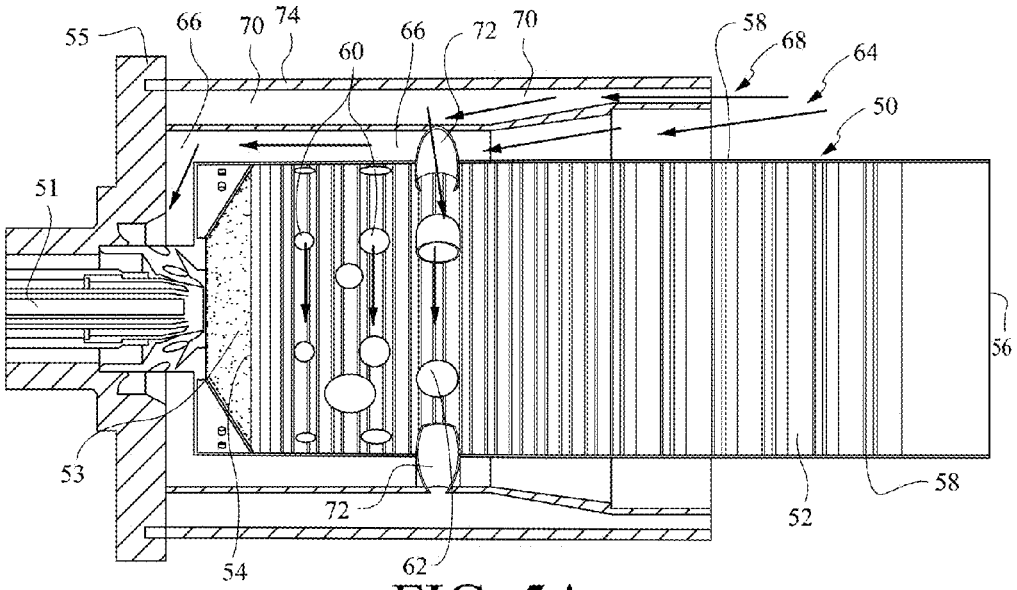
FIG. 5A to 5C show a second embodiment of a DLN combustion system incorporating the combustor liner shown in FIG. 5.
Figure 5B:
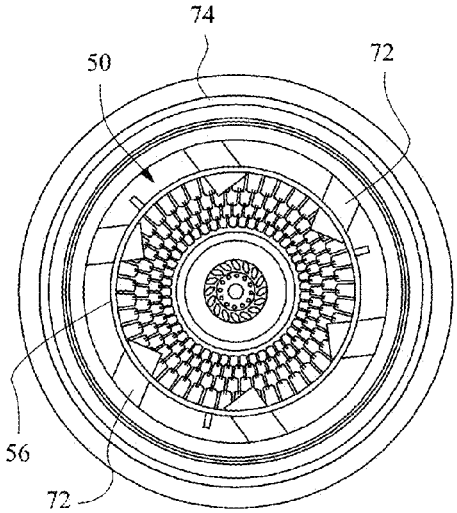
Figure 5C:
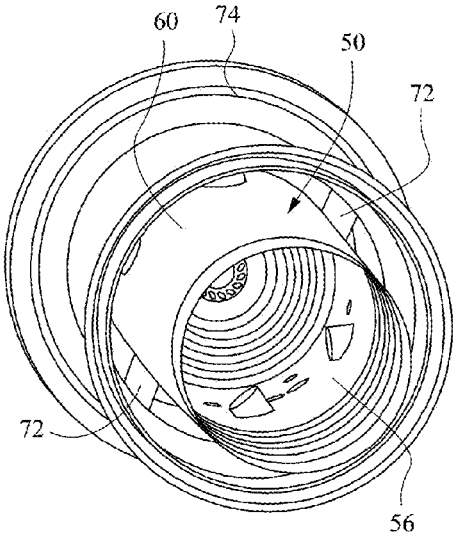
Figure 7:
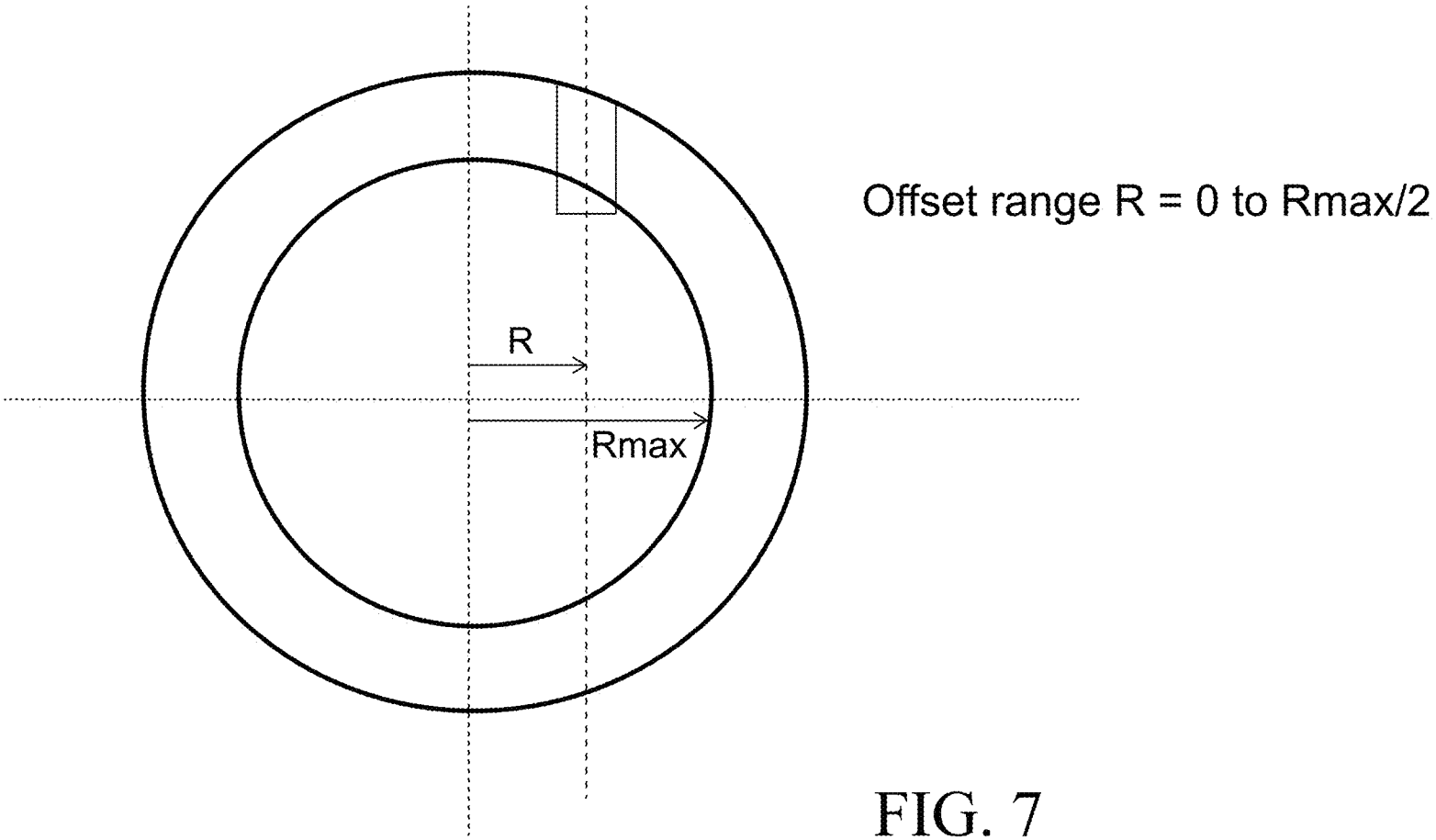
FIG. 7 is an end elevational representation of the angle at which the pipes enter the combustor in the embodiments of FIGS. 5A to 6C using a range of offsets of the pipes from the center of the combustor.

FIG. 5A to 5C show a second embodiment of a DLN combustion system incorporating the combustor 50 shown in FIG. 3. In the embodiment shown in FIG. 5A to 5C, the modified liner shown in the embodiment of FIGS. 4A to 4C is maintained. However, the embodiment shown in FIG. 5A to 5C also includes a modified cavity arrangement for much larger mixing of air with the combustion gases within the combustion chamber 28. Thus, as in the embodiment of FIGS. 4A to 4C, the dilution holes 52 are again moved to the third row of mixing holes 50 in combustor wall 62 so that dilution air is admitted into the combustor 50 at the third row of mixing holes 50, and, as such, the mixing holes 50 in the third row are removed. In the modified cavity arrangement, the mid-frame air 64 is divided into two paths, i.e., one path for a part of the mid-frame air 64 to continue to be admitted into the combustor 50 by entering through flow sleeve 66, and another path for another part 68 of the mid-frame air 64 to flow through a cavity 70 between the flow sleeve 66 and the outer shell 74, whereupon air flowing through the cavity 70 will tangentially enter the combustor 50 through a plurality of pipes 72 extending at an angle between the cavity 70 and the third row dilution holes 62 into the combustor 50. The air 68 entering the combustor 50 tangentially through pipes 72 results in an increase in air mixing with combustion gases 24 in the combustor primary zone. The angle at which the pipes 72 enter the combustor 50 in a preferred embodiment is achieved using a range of offsets of zero to seven inches of the pipes from the center of the combustor 50, as shown in FIG. 7. The mixing is improved because air flowing from the pipes 72 flows counterclockwise to the air flowing from the nozzle 51.

Figure 6A:
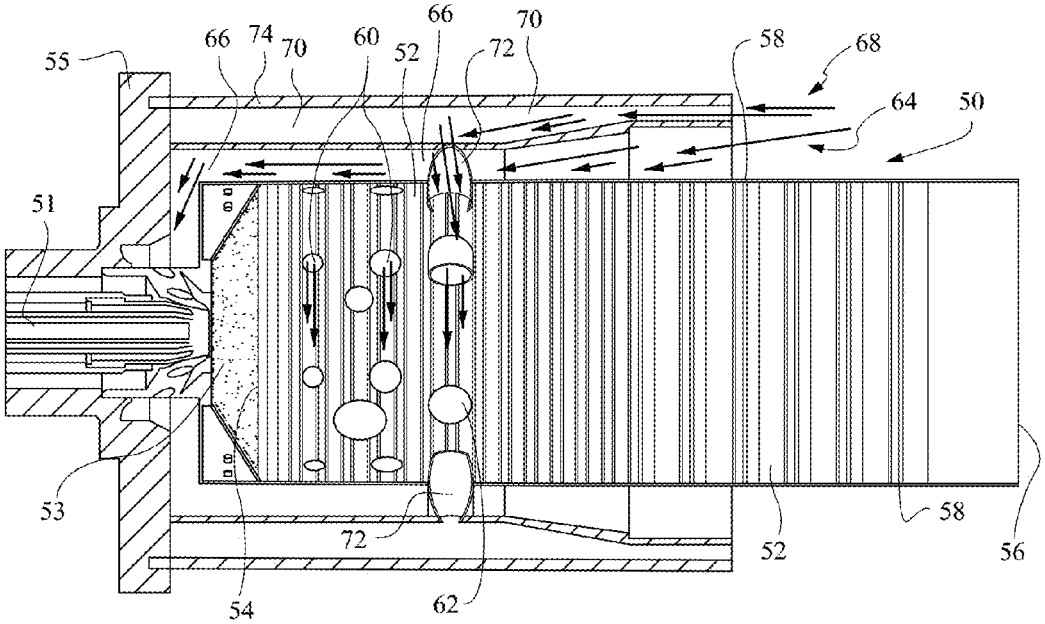
FIG. 6A to 6C show a third embodiment of a DLN combustion system incorporating the combustor liner shown in FIG. 5.
Figure 6B:
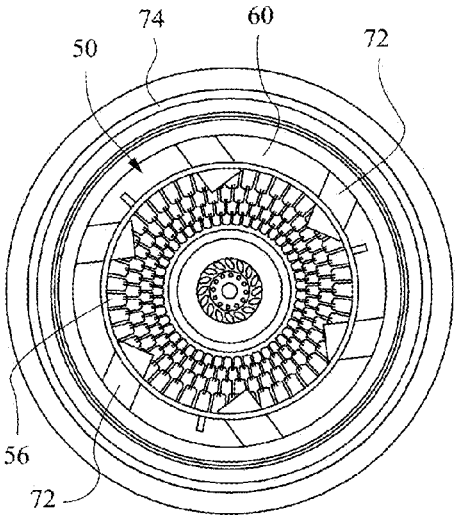
Figure 6C:
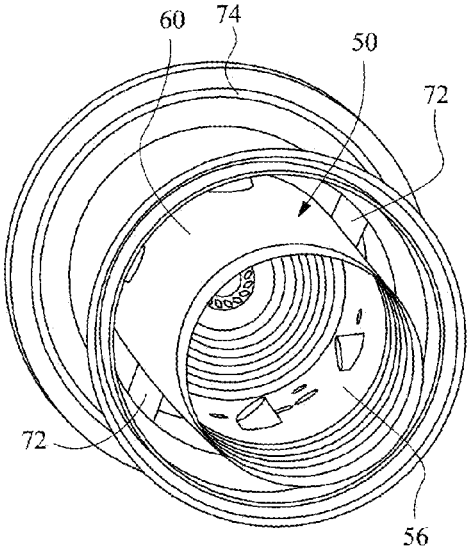

FIG. 6A to 6C show a third embodiment of a DLN combustion system incorporating the combustor 50 shown in FIG. 5. In the embodiment shown in FIG. 6A to 6C, the modified liner with relocated dilution holes, as shown in the embodiment of FIGS. 4A to 4C, is again used. In addition, the modified cavity arrangement for much larger mixing of air and combustion gases in the embodiment shown in FIG. 5A to 5C is again used. However, increased air flow of 10-15% is added to increase the penetration of air into the hot temperature zones in the combustion chamber 28. This is achieved by increasing the size/diameter of the dilution holes 62 though which air from pipes 72 is passed into combustor 50. Also, louver cooling air passing through the plurality of rows of louver cooling holes 58 in the combustor liner 50 is reduced by half from 25-35% of the mid-frame air flow 64 to 10-15% of the mid-frame air flow 64 by decreasing the size/diameter of the cooling holes 58. It is noted that 25-35% louver cooling is an old design, in which the liner temperature can reach to 800° F. to 1000° F. in temperature.

It should be noted that one alternative arrangement in which the larger dilution holes are used is one in which the mixing holes and larger dilution holes are arranged a single row located a distance from the fuel entry end 54 of the combustor liner 52 as would be the row of dilution holes 62 in the embodiment of FIGS. 3A to 3C would be.

Figure 8:
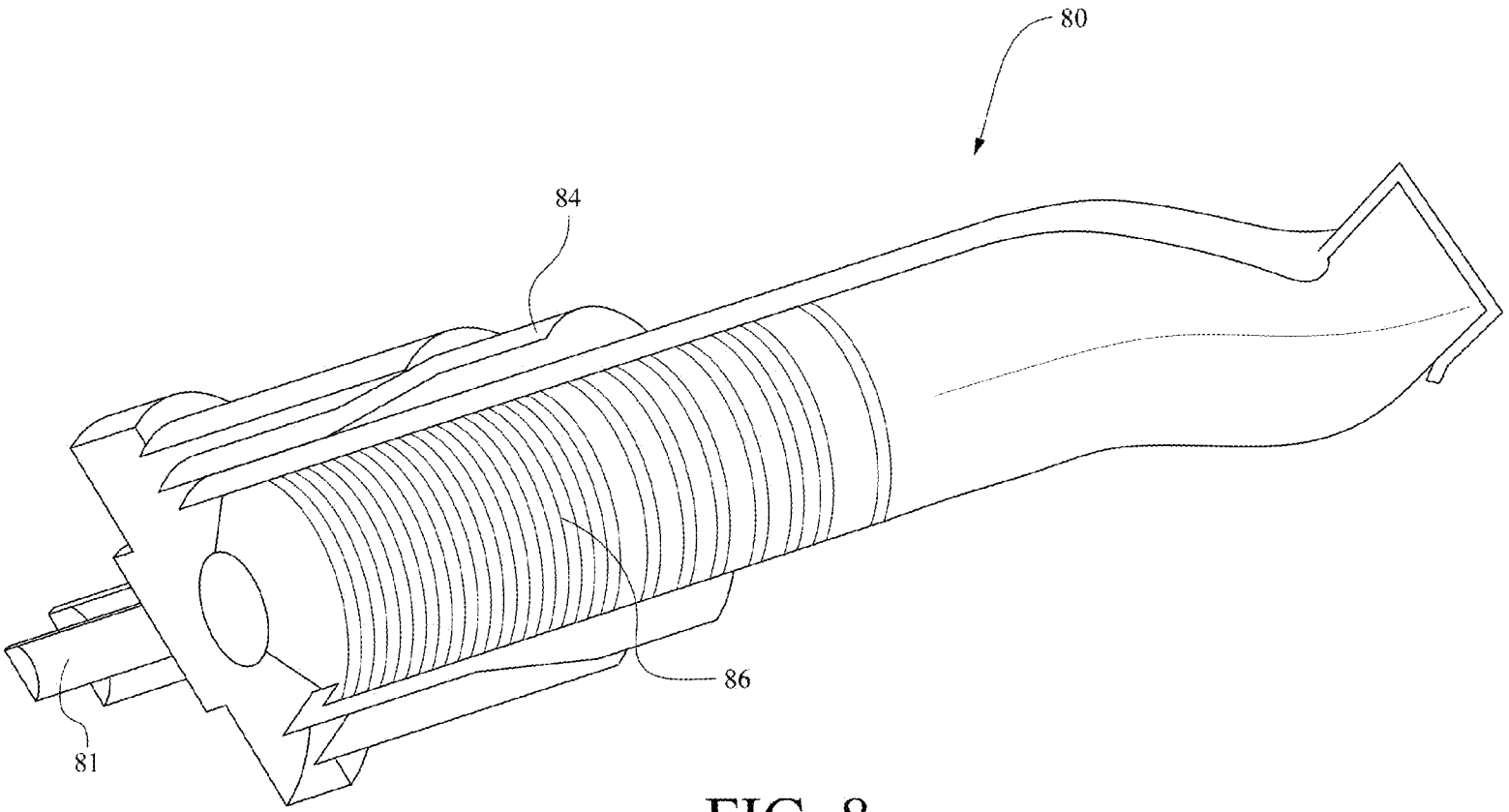
FIG. 8 is a partial breakaway perspective view of part of a diffusion type combustor.

FIG. 8 is a partial breakaway perspective view of part of a diffusion type combustor 80. The combustor includes an inlet nozzle 81, a combustor liner 82 with a cylindrical combustor wall, and a flow sleeve 84 through which mid-frame air enters the combustor 80.

Figure 9A:
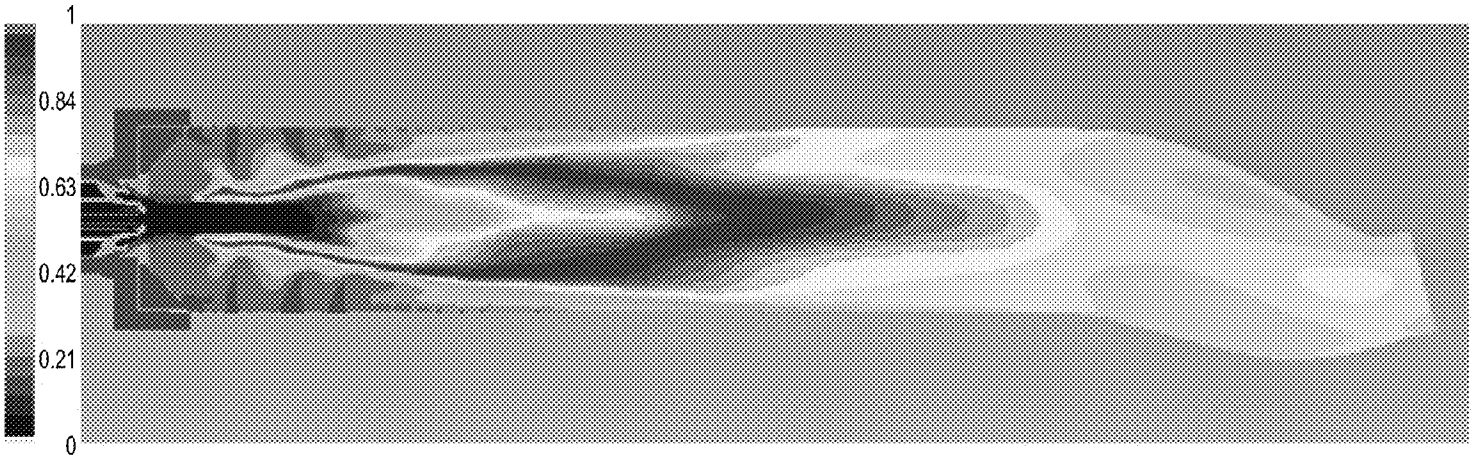
FIG. 9A is a picture of a temperature field within the diffusion type combustor of FIG. 8 during operation with a conventional type liner like that shown in FIGS. 2A and 2B.
Figure 9B:
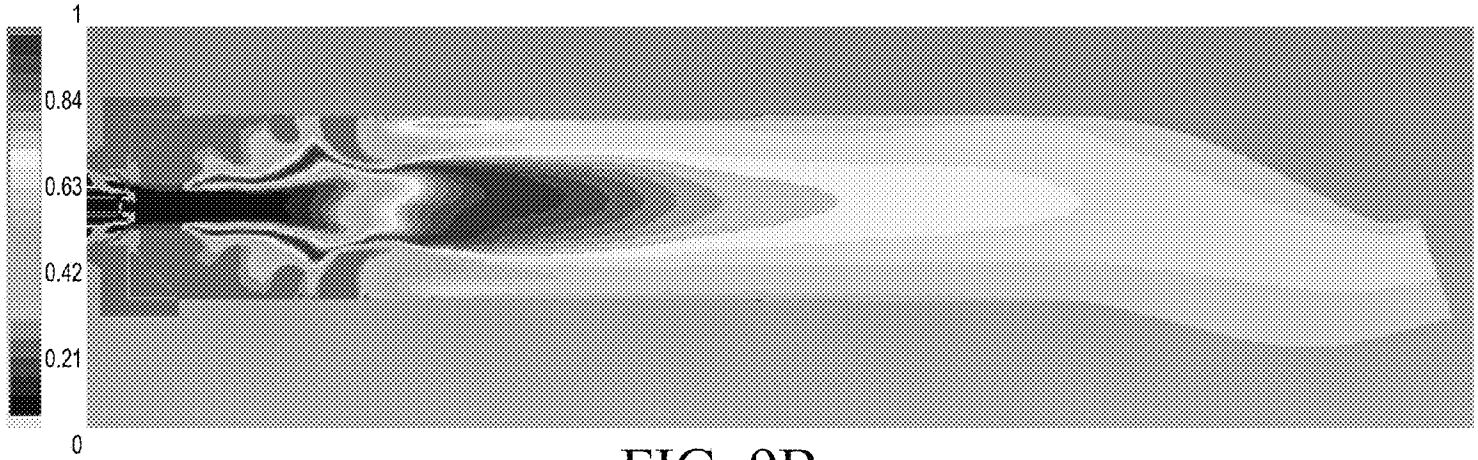
FIG. 9B is a picture of a temperature field within the diffusion type combustor of FIG. 8 during operation with a type liner according to the present invention like that shown in FIG. 3.

FIG. 9A is a picture of a temperature field within the diffusion type combustor 80 of FIG. 8 during operation with the liner 82 being a conventional type liner like that shown in FIGS. 2A and 2B. FIG. 9B is a picture of a temperature field within the diffusion type combustor 80 of FIG. 8 during operation with the liner 82 being of a type like that shown in FIG. 3. As can be seen in FIG. 9B where a type of liner like that shown in FIG. 3 is used, the temperatures in the combustor 80 are less than those shown in FIG. 9A where a conventional type liner like that shown in FIGS. 2A and 2B is used. It can be seen from FIGS. 9A and 9B that the high temperature reaction zone within the combustion chamber 28 is reduced significantly after the dilution holes 62 have been moved closer to the fuel entry end 54 of the cylindrical combustor wall 52, even though the exit profile of the combustor did not change much.

Figure 10A:
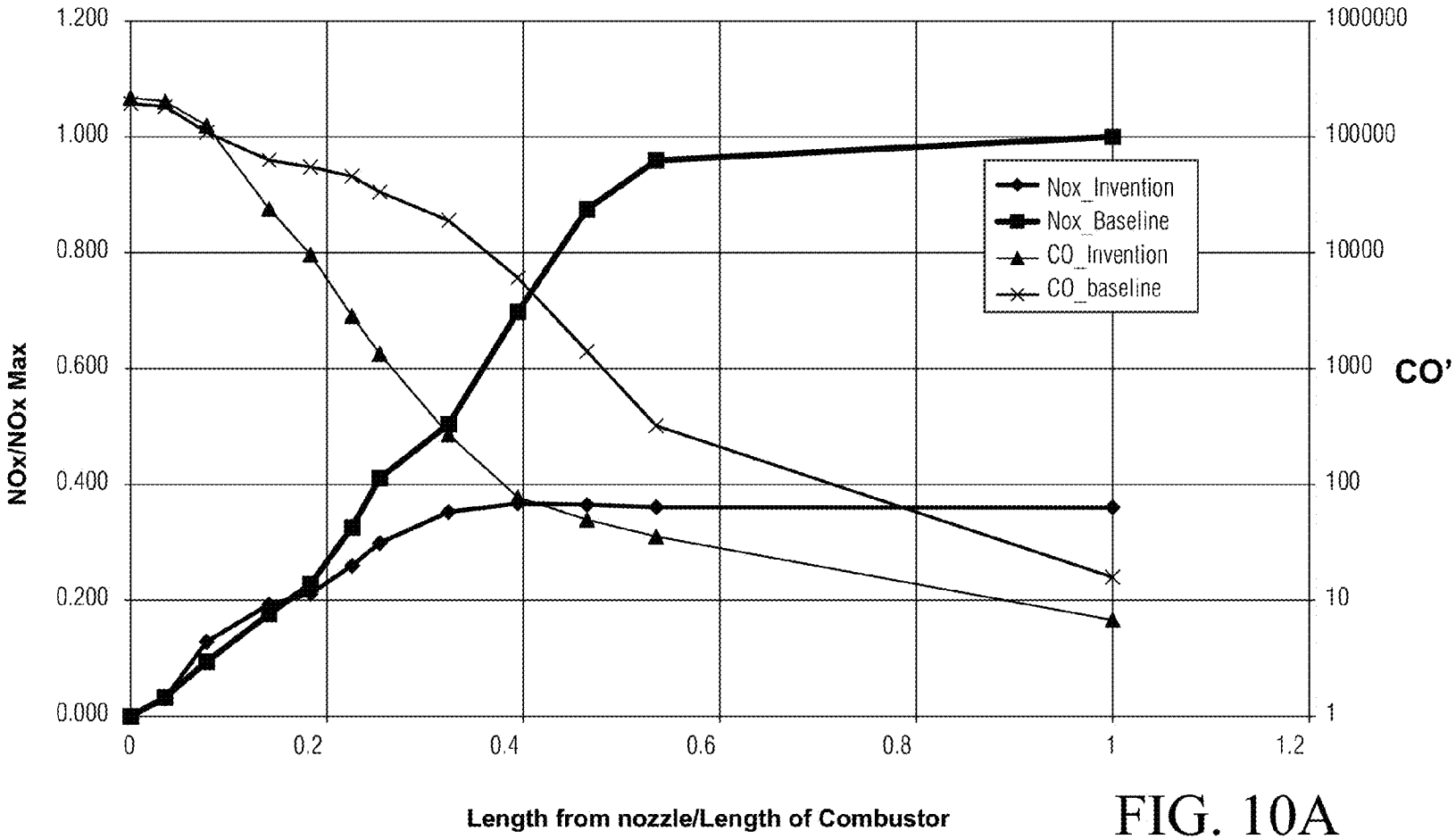
FIG. 10A is a graph of the emissions inside and that exit a diffusion type combustor like that of FIG. 8 during operation with a conventional type liner like that shown in FIGS. 2A and 2B and with a type liner according to the present invention like that shown in FIG. 3.
Figure 10B:
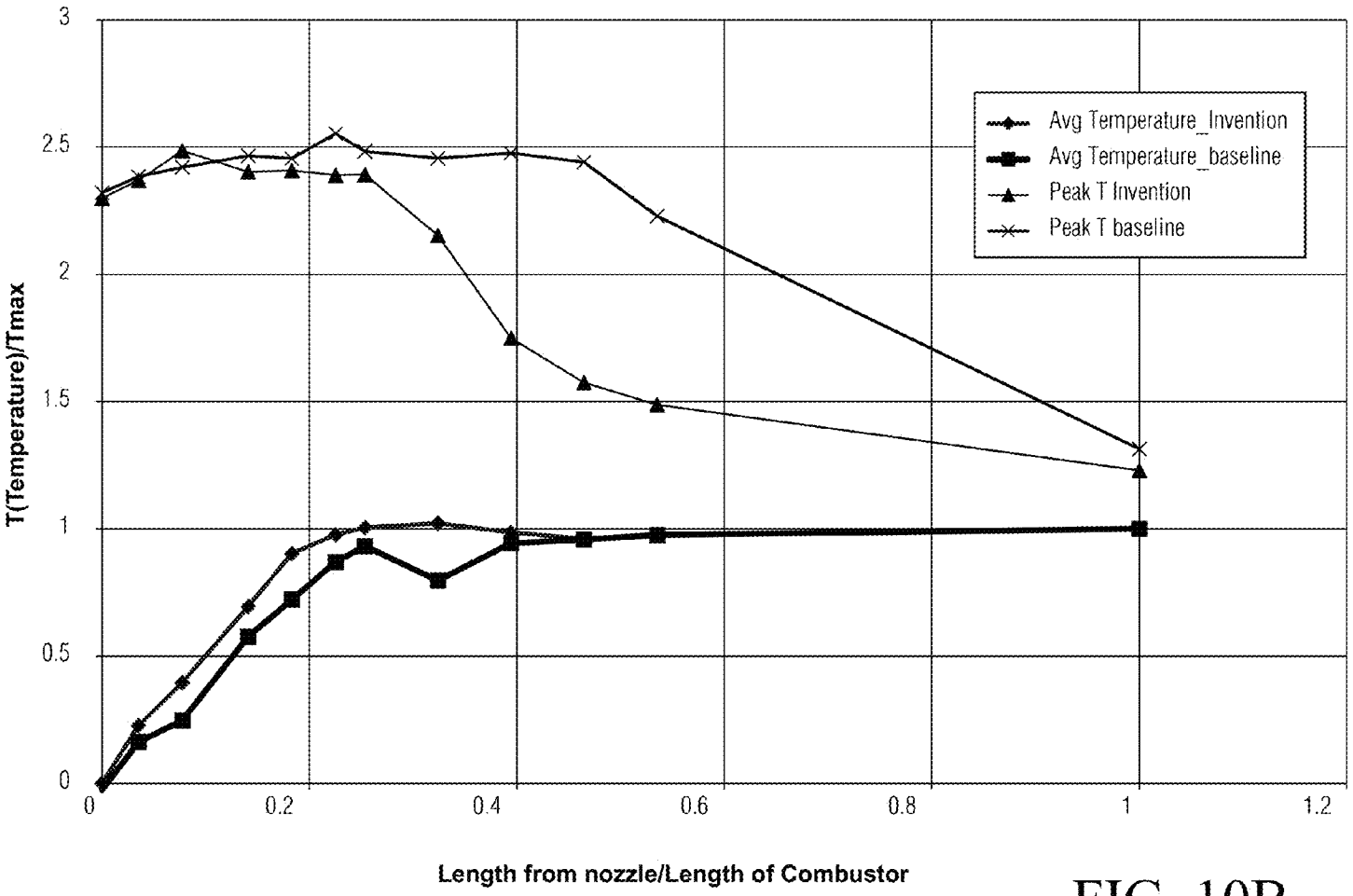
FIG. 10B is a graph of the temperature inside and that exit a diffusion type combustor like that of FIG. 8 during operation with a conventional type liner like that shown in FIGS. 2A and 2B and with a type liner according to the present invention like that shown in FIG. 3.

FIG. 10A is a graph of the emissions inside and that exit a diffusion type combustor 80 like that of FIG. 8 during operation with a conventional type liner like that shown in FIGS. 2A and 2B and with a type liner according to the present invention like that shown in FIG. 3. FIG. 10B is a graph of the temperature inside and that exit a diffusion type combustor like that of FIG. 8 during operation with a conventional type liner like that shown in FIGS. 2A and 2B and with a type liner according to the present invention like that shown in FIG. 3.

It can be seen from FIGS. 9A and 9B and the graph of FIG. 10B that the high temperature reaction zone within the combustion chamber 28 is reduced significantly after the dilution holes 62 have been moved closer to the fuel entry end 54 of the cylindrical combustor wall 52, so that the diffusion type combustor 80 of FIG. 8 was operated a liner 82 of a type like that shown in FIG. 3, even though the exit profile of the combustor did not change much. It can also be seen from the graph of FIG. 10A that the combustor 80 of FIG. 8, when operated with a liner 82 of a type like that shown in FIG. 3, reduces NOx emissions by approximately 65% and CO emissions by approximately 50% at the exit of combustor 80.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor operating with a compressor to drive a gas turbine, the combustor comprising:

an outer combustor wall having an upstream fuel entry end and a downstream turbine entry end;

a plurality of mixing holes located proximal to the upstream fuel entry end of the outer combustor wall;

a plurality of dilution holes, which exceeds four dilution holes, and which is arranged in a row which is located proximal to the plurality of mixing holes to admit air into a combustion zone in the combustor for mixing of the admitted air with combustion gases in the combustion zone to thereby reduce NOx and carbon monoxide (CO) production in the combustion zone;

an outer shell;

a nozzle from which compressed air and fuel are discharged into the combustor;

a flow sleeve located between the outer shell and the outer combustor wall so as to form a cavity between the outer shell and the outer combustor wall, and configured to divide air from the compressor entering the combustor between a first path by which a first part of the compressor air is admitted into the combustor by entering through the flow sleeve, and a second path by which a second part of the compressor air is admitted into the combustor through the cavity; and a plurality of pipes extending between the cavity and the plurality of dilution holes to admit the second part of the compressor air into the combustion zone for increased mixing of the admitted air with combustion gases in the combustion zone to thereby reduce NOx and carbon monoxide (CO) production in the combustion zone.

2. The combustor of claim 1, wherein the plurality of mixing holes are arranged in a plurality of rows which extend around a circumference of the outer combustor wall, and wherein the row of dilution holes are arranged so as to extend around the circumference of the outer combustor wall.

3. The combustor of claim 1, wherein the plurality of mixing holes are arranged in first and second rows which extend around a circumference of the outer combustor wall.

4. The combustor of claim 3, wherein the plurality of mixing holes is comprised of sixteen mixing holes and the plurality of dilution holes is comprised of six dilution holes.

5. The combustor of claim 1, wherein the plurality of pipes extend at an angle between the cavity and the plurality of dilution holes so that the second part of the compressor air passing through the plurality of pipes tangentially enters the combustor.

6. The combustor of claim 5, wherein the compressor air entering the combustor tangentially through the plurality of pipes results in an increase in air mixing with combustion gases in the combustor because air admitted from the plurality of pipes flows counterclockwise to the air flowing into the combustor from the nozzle.

7. The combustor of claim 1, wherein the combustor further comprises a plurality of rows of liner louver cooling holes positioned longitudinally along the combustor wall, and wherein the diameters of the plurality of dilution holes though which air from the plurality of pipes is passed into combustor are increased to a dimension that results in an increase in air flow into the combustor combustion chamber occurs, and wherein the diameters of the plurality of louver cooling holes though which louver cooling air passes are reduced that results in further increased mixing of the admitted air with combustion gases in the combustion zone to thereby further reduce NOx and carbon monoxide (CO) production in the combustion zone.

8. A combustor operating with a compressor to drive a gas turbine, the combustor comprising:

an outer combustor wall having an upstream fuel entry end and a downstream turbine entry end;

mixing holes proximal to the upstream fuel entry end of the outer combustor wall, the mixing holes arranged in rows which extend around a circumference of the outer combustor wall;

dilution holes arranged in at least one row which extends around the circumference of the outer combustor wall, the dilution holes located proximal to the mixing holes;

an outer shell;

a nozzle configured to discharge compressed air and fuel into the combustor;

a flow sleeve between the outer shell and the outer combustor wall so as to form a cavity between the outer shell and the combustor wall so that air from the compressor entering the combustor is divided between a first path by which a first part of the compressor air is admitted into the combustor by entering through the flow sleeve, and a second path by which a second part of the compressor air is admitted into the combustor through the cavity; and pipes extending between the cavity and the dilution holes configured to admit the second part of the compressor air into the combustion zone.

9. The combustor of claim 8, wherein the mixing holes are arranged in rows which extend around the circumference of the outer combustor wall, and wherein the dilution holes are arranged in at least one row which extends around the circumference of the outer combustor wall.

10. The combustor of claim 9, wherein the combustor further comprises a plurality of rows of liner louver cooling holes positioned longitudinally along the combustor wall, and wherein the diameters of the plurality of dilution holes though which air from the plurality of pipes is passed into combustor are increased to a dimension that results in an increase of air flow into the combustor combustion chamber, and wherein the diameters of the plurality of louver cooling holes though which louver cooling air passes are reduced to a dimension that results in increased mixing of the admitted air with combustion gases in the combustion zone to thereby further reduce NOx and carbon monoxide (CO) production in the combustion zone.

11. The combustor of claim 8, wherein the mixing holes are arranged in first and second rows which extend around the circumference of the outer combustor.

12. The combustor of claim 11, wherein the mixing holes are comprised of sixteen mixing holes and the dilution holes are comprised of six dilution holes.

13. The combustor of claim 8, wherein the pipes extend at an angle between the cavity and the plurality of dilution holes so that the second part of the compressor air passing through the plurality of pipes tangentially enters the combustor.

14. The combustor of claim 13, wherein the compressor air entering the combustor tangentially through the plurality of pipes results in air comes into the liner as a swirling flow in a direction opposite to nozzle swirl.

15. A combustor operating with a compressor to drive a gas turbine, the combustor comprising:

an outer combustor wall having an upstream fuel entry end and a downstream turbine entry end, the outer combustor wall having a length between 35 inches and 50 inches;

a plurality of rows of liner louver cooling holes positioned longitudinally along the combustor wall;

a plurality of mixing holes located proximal to the upstream fuel entry end of the outer combustor wall;

the plurality of dilution holes being located proximal to the plurality of mixing holes;

the plurality of mixing holes being arranged in first and second rows which extend around a circumference of the outer combustor wall rather than first, second and third rows which extend around the circumference of the outer combustor wall so that the plurality of dilution holes are arranged in the third row from the upstream fuel entry end extending around the circumference of the outer combustor wall so as to be located within a distance of five inches to forty inches from the fuel entry end of the combustor wall;

an outer shell;

a nozzle from which compressed air and fuel are discharged into combustor;

a flow sleeve located between the outer shell and the combustor wall so as to form a cavity between the outer shell and the combustor wall so that air from the compressor entering the combustor is divided between a first path by which a first part of the compressor air is admitted into the combustor by entering through the flow sleeve, and a second path by which a second part of the compressor air is admitted into the combustor through the cavity; and a plurality of pipes extending between the cavity and the plurality of dilution holes at an angle to thereby tangentially admit the second part of the compressor air into the combustion zone for increased mixing of the admitted air with combustion gases in the combustion zone, the angle at which the pipes enter the combustor being achieved using an offset of the pipes of zero to seven inches from the center of the combustor, the diameters of the plurality of dilution holes though which air from the plurality of pipes is passed into the combustor being increased to a dimension that results in an increase in air flow into the combustor combustion chamber, and the diameters of the plurality of louver cooling holes though which louver cooling air passes being reduced to a dimension that results in a further increase in mixing of the admitted air with combustion gases in the combustion zone to thereby reduce NOx and carbon monoxide (CO) production in the combustion zone.

* * * * *